US008956166B2

(12) United States Patent
Ritner

(10) Patent No.: US 8,956,166 B2
(45) **Date of Patent: *Feb. 17, 2015**

(54) APPARATUS FOR ELECTRICALLY CONNECTING A FLEXIBLE CIRCUIT TO A RECEIVER

(71) Applicant: Hi Rel Connectors, Inc., Claremont, CA (US)

(72) Inventor: William E. Ritner, Claremont, CA (US)

(73) Assignee: Hi Rel Connectors, Inc., Claremont, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/219,454

(22) Filed: Mar. 19, 2014

(65) Prior Publication Data

US 2014/0206210 A1 Jul. 24, 2014

Related U.S. Application Data

(63) Continuation-in-part of application No. 13/760,574, filed on Feb. 6, 2013, now Pat. No. 8,821,167.

(60) Provisional application No. 61/653,813, filed on May 31, 2012.

(51) Int. Cl.

| | |
|---|---|
| ***H01R 12/00*** | (2006.01) |
| ***H01R 13/52*** | (2006.01) |
| ***H01R 12/79*** | (2011.01) |
| ***H01R 13/24*** | (2006.01) |
| *H01R 13/193* | (2006.01) |

(52) U.S. Cl.

CPC ..... *H01R 13/5219* (2013.01); *H01R 12/79* (2013.01); *H01R 13/2407* (2013.01); *H01R 13/193* (2013.01)

USPC ..... 439/84

(58) Field of Classification Search

CPC ..... H01R 12/771; H01R 13/24; H01R 12/62; H01R 12/79; H01R 23/668; H01R 23/722

USPC ..... 439/83, 67–68, 492, 84

See application file for complete search history.

(56) References Cited

U.S. PATENT DOCUMENTS

| | | | | |
|---|---|---|---|---|
| 4,012,093 | A * | 3/1977 | Crane | 439/67 |
| 4,526,432 | A | 7/1985 | Cronin et al. | |
| 5,158,479 | A | 10/1992 | Mouissie | |
| 6,409,531 | B1 | 6/2002 | Millard | |
| 8,529,277 | B2 * | 9/2013 | Williams et al. | 439/75 |
| 8,821,167 | B2 * | 9/2014 | Ritner | 439/67 |
| 2007/0167089 | A1 | 7/2007 | Gobron et al. | |
| 2009/0149036 | A1 | 6/2009 | Lee et al. | |
| 2012/0315773 | A1 * | 12/2012 | Esquivel et al. | 439/67 |

* cited by examiner

*Primary Examiner* — Edwin A. Leon

(74) *Attorney, Agent, or Firm* — Cotman IP Law Group, PLC

(57) ABSTRACT

An electrical connector assembly combination includes a receptacle with a plurality of electrical contacts, and a connector device with housing configured to accept and retaining a terminal end of a flexible assembly comprising one or more flexible electrical conductors. The terminal end of the flexible assembly includes one or more electrical contacts. The connector device is capable of being reversibly coupled and interlocked with the receptacle such that each of the electrical contacts in the receptacle is electrically connected to a corresponding contact at the terminal end of the flexible assembly in a secure, removable and non-permanent manner.

20 Claims, 3 Drawing Sheets

APPARATUS FOR ELECTRICALLY CONNECTING A FLEXIBLE CIRCUIT TO A RECEIVER

CROSS-REFERENCE TO RELATED APPLICATIONS

This application is a continuation-in-part of U.S. patent application Ser. No. 13/760,574, filed on Feb. 6, 2013, which claims priority from U.S. Provisional Patent Application Ser. No. 61/653,813, filed on May 31, 2012, entitled "Apparatus for Electrically Connecting a Flexible Circuit to a Receiver," the specifications of which are incorporated herein by reference in their entirety.

FIELD OF THE INVENTION

The invention relates generally to electrical connection assemblies and, more particularly, to electrical connection assemblies for coupling a flexible electrical conductor to a rigid assembly, such as a circuit board.

BACKGROUND OF THE INVENTION

Sophisticated electrical and electronic components are frequently disposed proximate to high vibration equipment, such as aircraft and rocket engines. Because of the narrow confines wherein such components are typically disposed, interconnecting such components often employs the use of flexible electrical conductors ("flexible assemblies").

The prior art methods of attaching a flexible assembly to a rigid assembly (such as a circuit board) usually employ some form of permanent attachment, such as methods wherein the flexible assembly is soldered to the rigid assembly.

Problems arise in such prior art methods when the attachment between the flexible assembly and the rigid assembly needs to be disengaged (to repair the rigid assembly, or for other relevant purposes requiring disassembly or unmating of the assembly). Such activities cannot easily (if at all) be performed in the field, and, in most cases, require the complete replacement of both flexible assembly and rigid assembly. Such complete replacement of both assemblies is awkward, time-consuming and expensive.

Accordingly, there is a need for a method of attaching a flexible assembly to a rigid assembly which does not involve the aforementioned problems in the prior art.

SUMMARY OF THE INVENTION

An apparatus for electrically connecting a flexible electrical assembly with conductors to a receiver is presented. One or more embodiments of invention comprise an electrical assembly combination comprising a receiver with a plurality of electrical contacts. The receiver may be mounted on a rigid assembly, e.g. a circuit board, and the electrical contacts are connected to electrical circuits/elements on the rigid assembly. The receiver may also include an insulator assembly to electrically isolate the electrical contacts from one another.

One or more embodiments of the invention further comprise a connector device configured to retain at least one terminal end of a flexible conductor assembly (hereby also referred to as "flexible assembly"). The terminal end of the flexible conductor assembly also includes one or more electrical contacts to the conductors in the flexible assembly. The connector device is configured to be reversibly coupled to the receiver such that the electrical contacts in receiver are electrically connected to the electrical contacts at the terminal end of the flexible conductor assembly in a removable, non-permanent manner. In one or more embodiments, coupling of the connector to the receptacle is preferably by a twist and lock.

An objective of this invention is an apparatus specifically for electrically and mechanically connecting a rigid, semi-rigid and/or flexible circuit/conductor assembly using replaceable and repairable conductive elements found within the flexible circuit directly to a receiver termination point, wherein the termination point has a plurality of conductive elements located within the receiver in a manner that: a) a connector device houses the flexible circuit and flexible circuit elements and the receiver contains the receiver conductive elements and; b) the connector device may be non-destructively disconnected from the receiver and; c) some or all of the conductive elements may be replaceable and/or repairable within the apparatus and; d) the flexible circuit conductive elements may be non-destructively engaged and/or disengaged with the receiver conductive elements and; e) physically isolates the connected end of the flexible circuit and mating interface of the receiver termination point from both foreign contaminates and stray electrical transients and; f) maintains both electrical connectivity and contaminant protection when subject to extreme environments including, but not limited to, mechanical, thermal, electrical, and chemical stresses.

A feature of preferred embodiments of this combination includes an enclosure for accepting and retaining the flexible circuit mating end (i.e. terminal end) such that the flexible circuit may be non-destructively removed from the enclosure, and positions the flexible circuit within the enclosure in a manner that allows the electrically conductive elements within the flexible circuit to be exposed to the conductive elements within the receiver in order to make physical contact and become electrically interconnected with the flexible circuit conductive elements in a non-permanent form that would allow the flexible circuit conductive elements to become disengaged from the receiver conductive elements without causing damage to either the flexible circuit conductive elements or the receiver conductive elements.

In One or more embodiments, the combination includes a plurality of conductive elements within both the flexible circuit and receiver, wherein the flexible circuit conductive elements and receiver conductive elements may physically couple in a manner that creates an electrical connection between the two mated elements, and the mated elements may be disconnected from each other without causing damage to either of the conductive elements, and the conductive elements may be removed from their retention feature within their respective housing without causing damage to either the conductive element or retention feature or housing, and may be configured using existing solderless connection methods, including but not limited to: pin-socket mating systems, spring probe systems and compressive contact systems.

One or more embodiments of the invention may further include a physical seal or barrier between both the enclosure for the flexible circuit and the receiver that prevents any undesirable foreign elements, including both physical contaminants and stray electrical transients, from entering the engagement area between the flexible circuit conductive elements and the receiver conductive elements.

One or more embodiments of the invention may further include an interlocking mechanism between both the flexible circuit enclosure device (i.e. connector device) and the receiver that upon full engagement of the interlocking mechanism: a) the flexible circuit conductive elements are electrically connected with the receiver conductive elements and; b) the seal between the flexible circuit enclosure and receiver prevents foreign contamination, including both physical contaminants and stray electrical transients.

In one or more embodiments of the invention, the interlocking mechanism prevents the enclosure from disengaging from the receiver during operation of the apparatus in harsh environments, e.g. under extreme vibration.

The combination may further incorporate active and passive accessories and components, such as signal filters, signal indicators and power regulators. The apparatus may further incorporate design features, such as "scoop-proof" components or keying features to ensure proper alignment of conductive elements.

BRIEF DESCRIPTION OF THE DRAWINGS

These and other features, aspects and advantages of the present invention will become better understood with reference to the following description, appended claims and accompanying drawings where:

DETAILED DESCRIPTION OF THE INVENTION

Figure 1:
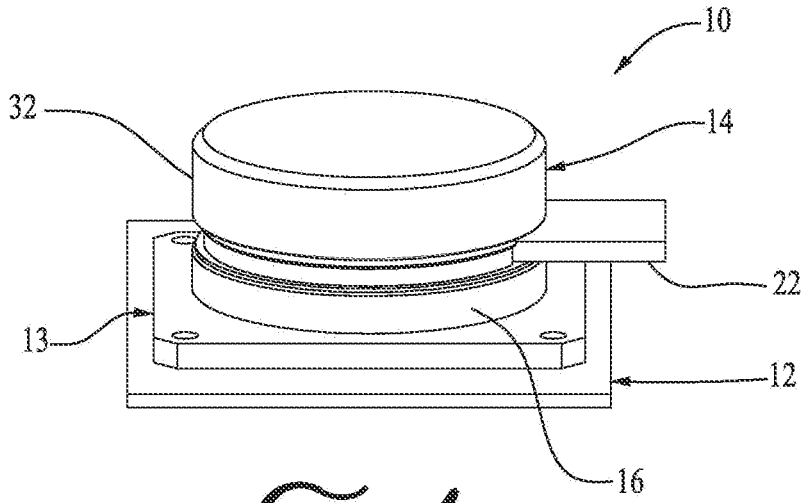
FIG. 1 is a perspective view of an electrical assembly combination in accordance with one or more embodiments of the present invention.

An apparatus for electrically connecting at least one flexible electrical assembly with conductors to a receiver will now be described. In the following exemplary description numerous specific details are set forth in order to provide a more thorough understanding of embodiments of the invention. It will be apparent, however, to an artisan of ordinary skill that the present invention may be practiced without incorporating all aspects of the specific details described herein. Furthermore, although steps or processes are set forth in an exemplary order to provide an understanding of one or more systems and methods, the exemplary order is not meant to be limiting. One of ordinary skill in the art would recognize that the steps or processes may be performed in a different order, and that one or more steps or processes may be performed simultaneously or in multiple process flows without departing from the spirit or the scope of the invention. In other instances, specific features, quantities, or measurements well known to those of ordinary skill in the art have not been described in detail so as not to obscure the invention. Readers should note that although examples of the invention are set forth herein, the claims, and the full scope of any equivalents, are what define the metes and bounds of the invention.

For a better understanding of the disclosed embodiment, its operating advantages, and the specified object attained by its uses, reference should be made to the accompanying drawings and descriptive matter in which there are illustrated exemplary disclosed embodiments. The disclosed embodiments are not intended to be limited to the specific forms set forth herein. It is understood that various omissions and substitutions of equivalents are contemplated as circumstances may suggest or render expedient, but these are intended to cover the application or implementation.

The term "first", "second" and the like, herein do not denote any order, quantity or importance, but rather are used to distinguish one element from another, and the terms "a" and "an" herein do not denote a limitation of quantity, but rather denote the presence of at least one of the referenced item.

One or more embodiments of the invention provide an electrical assembly combination for electrically/electronically connecting a flexible circuit (e.g. cable, flat cable, etc.) to a receiver. The electrical assembly combination apparatus comprises a connector configured to couple to a receiver. The connector comprises an enclosure for a terminal end of a flexible circuit configured such that the flexible circuit may be non-destructively removed from the enclosure. The flexible circuit is contained in the enclosure such that the conductive elements at the terminal end are exposed at an end where the connector is coupled with the receiver. The conductive elements are non-permanently electrically connected to conductive elements in the flexible circuit. The conductive elements consist of electrically conductive materials physically configured to engaged and disengage in a nondestructive manner by conventional or nonconventional means. The connector enclosure may also be configured with a first half of an interlocking mechanism, e.g. a connector interlocking cap.

In one or more embodiments, the receiver may be mounted on a rigid assembly, e.g. a circuit board. The receiver includes a receptacle and one or more the electrical contacts inside that are connected to electrical circuits/elements on the rigid assembly. The receptacle is configured with a second half of the interlocking mechanism, i.e. a receiver interlocking member. The receiver may also include an insulator assembly to electrically isolate its electrical contacts from one another.

One or more embodiments of the invention further comprise seals between the connector device and receiver to prevent contamination from foreign elements, including both physical contaminants and stray electrical transients. The seals may comprise components in the connector device, the receiver, or both.

The interlocking mechanism typically comprises features that ensure secure engagement between the conductive elements in the flexible circuit and the conductive elements in the receiver.

In one or more embodiments of the invention, when coupled, the interlocking mechanism prevents the connector from disengaging from the receiver and to maintain electrical contact during operation of the apparatus in extreme environments, e.g. under extreme vibration.

One or more embodiments of the invention may further include an interlocking mechanism between both the flexible circuit enclosure device (i.e. connector device) and the receiver that upon full engagement of the interlocking mechanism: a) the flexible circuit conductive elements are electrically connected with the receiver conductive elements and; b) the flexible circuit enclosure and receiver are sealed as one unit to prevent foreign contamination, including both physical contaminants and stray electrical transients.

A detailed description of the specific components and optional components of the apparatus for electrically connecting a flexible electrical assembly with conductors to a receiver in accordance with an embodiment of the present invention will be described using the illustrations of FIGS. 1 to 4.

Figure 2:
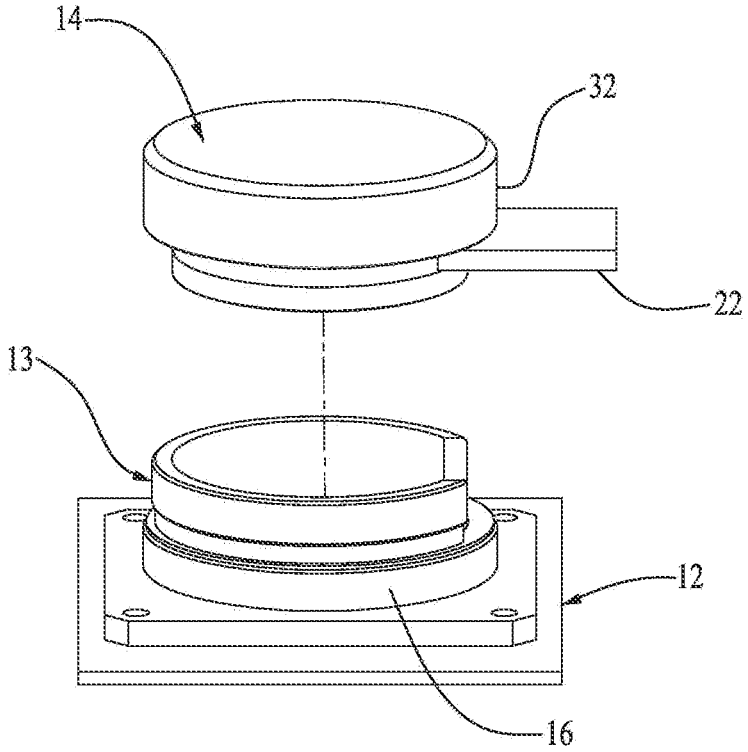
FIG. 2 is perspective view of the connector device separated from the receiver in accordance with one or more embodiments of the present invention.
Figure 3:
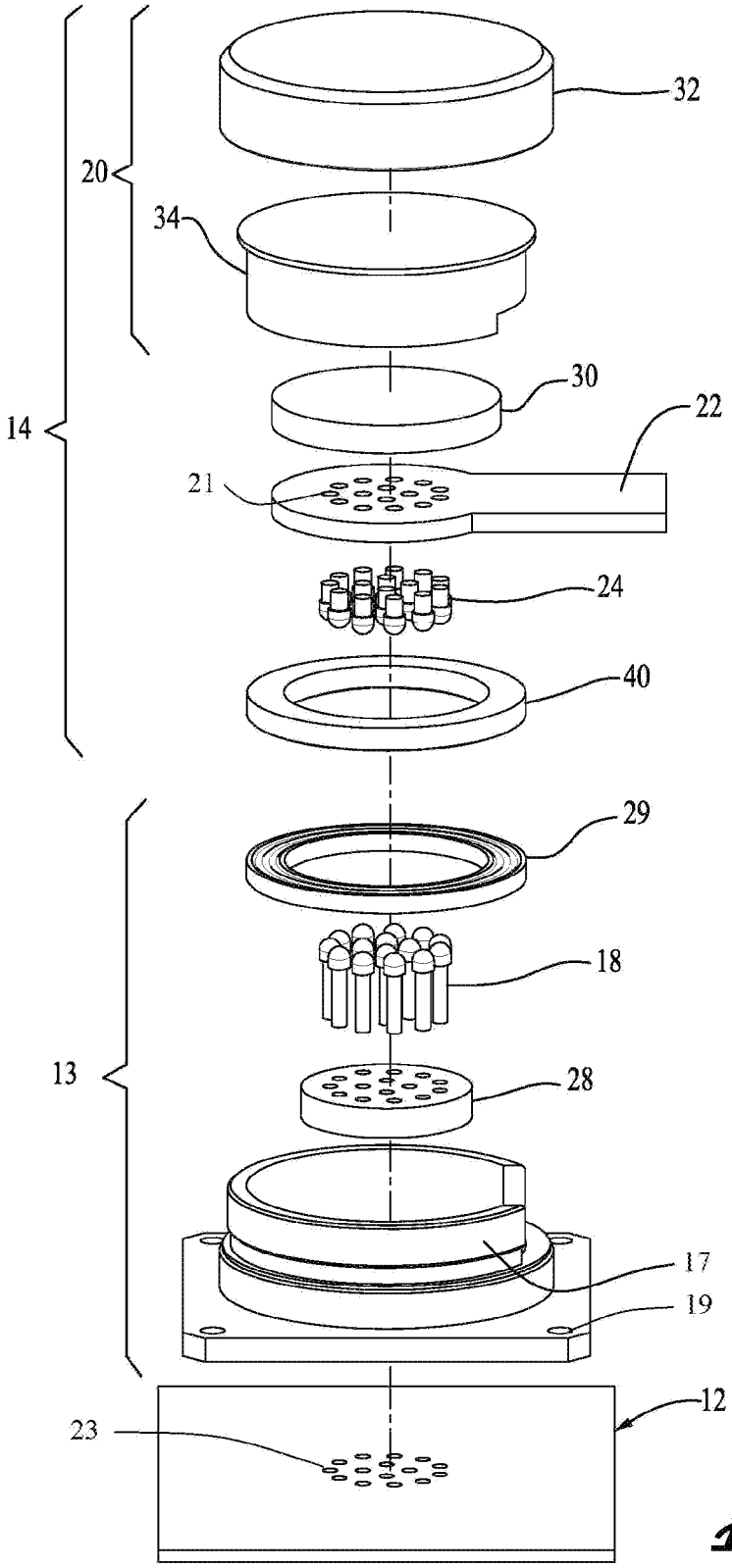
FIG. 3 is a fully exploded perspective view of the electrical assembly combination in accordance with one or more embodiments of the present invention.
Figure 4:
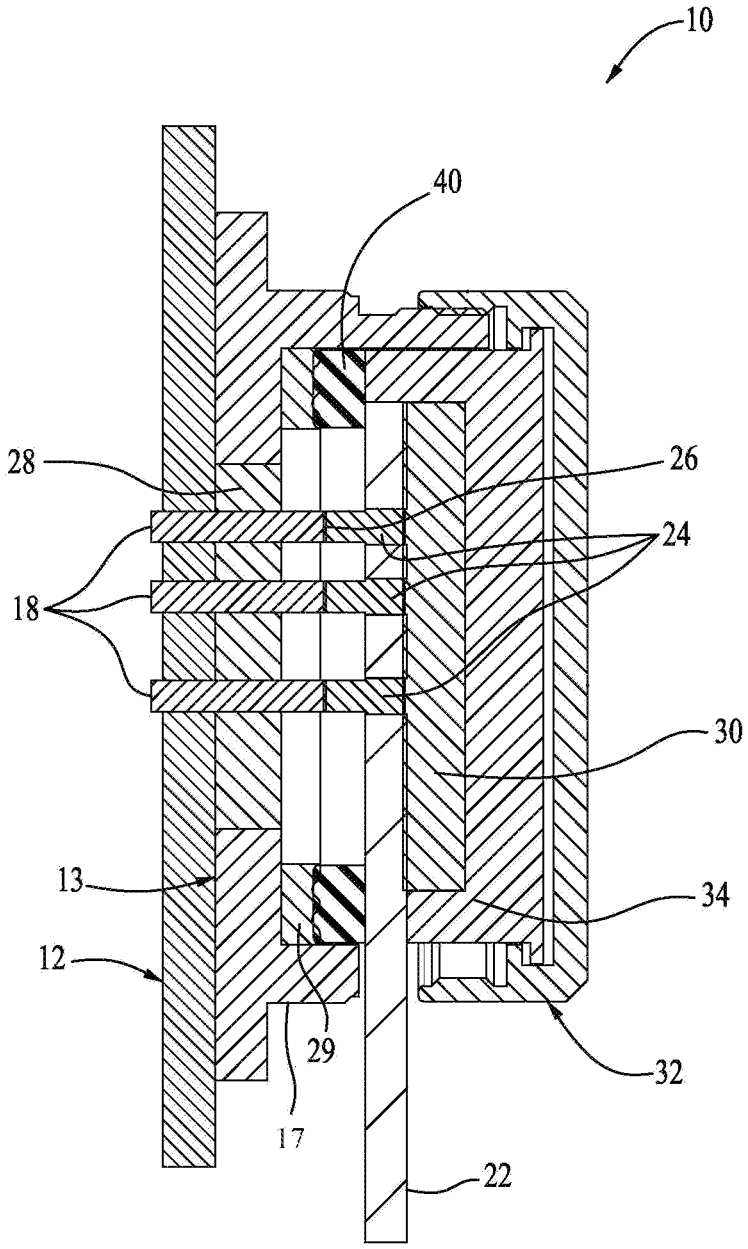
FIG. 4 is a cross-sectional view of the electrical assembly combination illustrated in FIG. 1.

One embodiment of the electrical assembly combination 10 is illustrated in FIG. 1. FIG. 2 illustrates the receiver and connector device individually. FIG. 3 is a fully exploded view of the electrical assembly combination, and FIG. 4 is a cross-sectional view of the electrical assembly combination, showing how the principal component parts are assembled.

An embodiment of the invention comprises an electrical assembly combination 10 useful in connecting a flexible assembly 22 to a rigid assembly 12. The invention comprises a receiver 13 and a connector device (i.e. plug) 14.

The receiver 13 comprises a receiver housing 16, receiver interlocking member or receptacle 17 and one or more of receiver housing electrical contacts 18. The receiver 13 is configured to be coupled to the rigid assembly 12. Coupling may be by gluing, with nuts and bolts (not shown) through a plurality of holes on the receiver housing, e.g. 19, or other means.

In one or more embodiments, the rigid assembly 12 is a circuit board, although the invention can also be used with other types of rigid assemblies.

The receiver 13 comprises one or more receiver housing electrical contacts 18. Receiver housing electrical contacts 18 may be configured as part of the receiver assembly 13, or separate and replaceable, etc. As illustrated, each receiver housing electrical contact 18 may be separable and replaceable and configured to mechanically and electrically connect with electrical contact slots 23 on the rigid assembly 12.

In one or more embodiments, the Receiver interlocking receptacle 17 is configured as one half of an interlocking mechanism and is configured to mechanically mate (i.e. couple) with a second half of the interlocking mechanism located on the connector device 14. Mating or coupling of connector 14 to receiver 13 via the interlocking mechanism may be accomplished through a twist-to-lock mechanism, for example. Those of skill in the art would appreciate that other types of interlocking mechanisms may be used without deviating from the spirit of the invention. For instance, nuts and bolts, push-twist-and-lock, pull-twist-and-lock, etc. are all possible types of interlocking mechanisms.

In one or more embodiments, the receiver 13 further comprises an insulator assembly 28. Insulator assembly is configured to provide electrical isolation between members of the one or more of receiver housing electrical contacts 18 and also for isolating the one or more receiver housing electrical contacts 18 from any conducting elements in the receiver housing. The insulator assembly is used to mechanically retain, electronically isolate and insulate the receiver housing electrical contacts 18. Insulator assembly 28 can be constructed of glass-filled epoxy resin or other non-conductive materials.

In one or more embodiments, the receiver 13 further comprises an optional sealing component 29 for sealing the receiver housing 16 to the connector device 14.

The optional sealing component 29 provides a seal to protect the space between the various components of the electrical assembly combination to prevent contamination from foreign entities. Such seal acts in a manner that prevents any undesirable foreign entities from entering the engagement area between the flexible assembly electrical contacts and the receiver housing electrical contacts. Sealing component 29 could be a grommet (e.g. rubber) and/or gasket, washer, etc. and is configured to serve an array of functions, such as, but not limited to, environmental sealing, EMI/EMC bonding, vibration dampening and air volume reduction.

The connector device 14 comprises a connector housing 20 configured to accept and retain at least one terminal end of a flexible assembly 22. The terminal end of flexible assembly 22 includes one or more flexible assembly electrical contacts 24. Flexible assembly electrical contacts 24 may be configured as part of the terminal end of flexible assembly 22, or separate and replaceable, etc. As illustrated, each flexible assembly electrical contact 24 may be separable and replaceable and configured to mechanically and electrically connect with electrical contact slots 21 at the terminal end of flexible assembly 22.

In one or more embodiments, the connector housing 20 comprises a flexible device enclosure 34 and a connector interlocking cap 32. The flexible device enclosure 34 and the connector interlocking cap 32 serve the purpose of enclosing and sealing the terminal end of flexible assembly 22 and also to provide environmental, EMI/EMC protection. The connector interlocking cap 32 can be made from a variety of materials such as, but not limited to, aluminum, titanium, steel and composites (conductive and non-conductive). The connector interlocking cap 32 is configured as the second half of the interlocking mechanism and is configured to couple with the receptacle interlocking mechanism 17.

The flexible device enclosure 34 and the connector interlocking cap 32 may be configured as separate components or assembled to one another with various mechanical retention elements such as, but not limited to, bolts, threaded studs and captive screws. As separate components, the interlocking cap 32 fits over the flexible device enclosure and configured to lock onto receptacle interlocking element 17, as illustrated in FIG. 4.

As noted above, the connector housing 20 retains the terminal end of the flexible assembly 22, such that the flexible assembly 22 may be non-destructively removed from the enclosure 34. The connector housing 20 is configured such that the flexible assembly electrical contacts 24 at the terminal end of flexible assembly 22 are exposed to the receiver housing electrical contacts 18 in order to make physical contact and become electrically interconnected with the receiver housing contacts 18 in a non-permanent form when connector device 14 and the receiver 13 are coupled together via connector interlocking cap 32 and receiver interlocking member 17. Such non-permanent interconnection allows for disengagement of the flexible assembly electrical contacts 24 from the receiver housing electrical contacts 18 without causing damage to either the flexible assembly electrical contacts 24 or to the receiver housing electrical contacts 18.

In one or more embodiments, the connector device 14 further comprises a compression grommet 30 constructed of silicon or other compressive and non-conductive material. The compression grommet 30 provides support for flexible assembly 22 inside of the connector device 14 and dampens movement when the connector device 14 is subject to vibration.

In one or more embodiments, the connector device 14 further comprises a flexible assembly retention component 40 which securely retains the flexible assembly 22 within the connector device 14.

One or more embodiments of connector device 14 may further comprise active and passive accessories and components, such as signal filters, signal indicators and power regulators. The connector device 14 may further incorporate design features, such as "scoop-proof" components or keying features to ensure proper alignment of conductive elements 18 and 24.

The flexible assembly 22 can comprise an optional sealing grommet (not shown) to seal the flexible assembly within the connector housing. Such sealing grommet provides a sealing interface between the flexible assembly 22 and the connector housing 20.

The connector device 14 is configured to be reversibly couplable to the receiver 13, such that each of the receiver housing electrical contacts 18 is electrically connected to a flexible assembly electrical contact 24 in a removable, non-permanent manner. Thus, all electrical contacts 18 and 24 may be both serviceable and solderless. Each receiver housing electrical contact 18 is mated to a flexible assembly electrical contact 24 by one of several solderless connection methods known in the art, including, but not limited to, pin-socket mating systems; spring probe systems and compressive contact systems. In the embodiment illustrated in FIG. 4, each receiver housing electrical contact 18 is mated to a corresponding flexible assembly electrical contact 24 at a conductive element engagement surface 26.

The connector housing 20 is used as a structural member and as support for the flexible assembly 22, as well as for vibration dampening purposes. The connector housing 20 can be made from a multitude of materials, including but not limited to the following: aluminum, titanium, steel, plastic, Polyether ether ketone (PEEK), as well as composites (conductive or non-conductive). The shape of the connector housing 20 can be circular, rectangular, as well as other shapes. The connector housing 20 can have multiple entry locations for a plurality of flexible assemblies 22.

The electrical assembly combination 10 facilitates the installation and replacement of a flexible assembly 22 to a rigid assembly 12 without the use of solder or other permanent connection methods. Furthermore, the electrical assembly combination of the invention 10 is configured such that the flexible assembly 22 and the rigid assembly 12 do not become disengaged during operation of the combination in environments that would otherwise cause disengagement, thereby making the electrical assembly combination useful in extreme environments. The several sets of mated electrical contacts 18 and 24 may be individually disconnected from each other at a conductive element engagement surface 26 without causing damages to any of the contacts 18 and 24, and any contact 18 and 24 may be removed from its respective retention structure without causing damages to the contact 18 and 24 or to the retention structure.

While the invention herein disclosed has been described by means of specific embodiments and applications thereof, numerous modifications and variations could be made thereto by those skilled in the art without departing from the scope of the invention set forth in the claims.

What is claimed is:

1. An electrical assembly combination comprising:

a receiver comprising a receiver housing and a plurality of receiver housing electrical contacts, wherein said receiver housing is configured at a first end to mechanically couple to a rigid assembly with a plurality of rigid assembly electrical contacts such that each one of said plurality of receiver housing electrical contacts is electrically coupled to a corresponding one of said plurality of rigid assembly electrical contacts, wherein said receiver housing includes a receiver slot at a second end configured for a flexible assembly; and a connector comprising a connector interlocking cap, a flexible device enclosure inside said connector interlocking cap and a compression grommet inside said flexible device enclosure, wherein said connector interlocking cap is configured for direct coupling with said second end of said receiver housing, wherein said flexible device enclosure includes a connector slot for said flexible assembly and an internal chamber configured for said compression grommet and a terminal end of said flexible assembly, wherein said terminal end of said flexible assembly comprises a plurality of flexible assembly electrical contacts, wherein said connector is configured such that each one of said plurality of flexible assembly electrical contacts is mated to a corresponding one of said plurality of receiver housing electrical contacts by a solderless connection within an enclosed formed when connector is coupled with said receiver housing.

2. The electrical assembly combination of claim 1, wherein said receiver housing further comprises a receiver interlocking member at said second end.

3. The electrical assembly combination of claim 2, wherein said connector interlocking cap and said receiver interlocking member are configured to couple through a twist-to-lock mechanism.

4. The electrical assembly combination of claim 1, wherein said solderless connection comprises a pin-socket mating system.

5. The electrical assembly combination of claim 1, wherein said solderless connection comprises a spring probe system.

6. The electrical assembly combination of claim 1, wherein said solderless connection comprises a compressive contact system.

7. The electrical assembly combination of claim 1, wherein said connector further comprises a flexible assembly retention component configured to securely retain the flexible assembly terminal within the connector.

8. The electrical assembly combination of claim 1, wherein said connector slot on said flexible device enclosure and said receiver slot are configured to align when said connector is coupled to said receiver.

9. The electrical assembly combination of claim 1, wherein said receiver further comprises an insulator assembly configured to electrically isolate each one of said plurality of receiver housing electrical contacts from each other.

10. An electrical assembly combination comprising:

a receiver comprising a receiver housing and a plurality of receiver housing electrical contacts, wherein said receiver housing is configured at a first end to mechanically couple to a rigid assembly with a plurality of rigid assembly electrical contacts such that each one of said plurality of receiver housing electrical contacts is electrically coupled to a corresponding one of said plurality of rigid assembly electrical contacts, wherein said receiver housing further comprises a receiver interlocking member at a second end; and a connector comprising a connector interlocking cap, a flexible device enclosure inside said connector interlocking cap and a compression grommet inside said flexible device enclosure, wherein said connector interlocking cap is configured for direct coupling with said receiver interlocking member, wherein said flexible device enclosure includes a connector slot for said flexible assembly and an internal chamber configured for said compression grommet and a terminal end of said flexible assembly, wherein said terminal end of said flexible assembly comprises a plurality of flexible assembly electrical contacts, wherein said connector is configured such that each one of said plurality of flexible assembly electrical contacts is mated to a corresponding one of said plurality of receiver housing electrical contacts by a solderless connection within an enclosure formed when said connector is coupled with said receiver housing.

11. The electrical assembly combination of claim 10, wherein said solderless connection comprises a compressive contact system.

12. The electrical assembly combination of claim 10, wherein said connector further comprises a flexible assembly retention component configured to securely retain the flexible assembly terminal within the connector.

13. The electrical assembly combination of claim 10, further comprising a sealing complement for sealing any space between said receiver housing and said connector.

14. The electrical assembly combination of claim 10, wherein said receiver further comprises an insulator assembly configured to electrically isolate each one of said plurality of receiver housing electrical contacts from each other.

15. The electrical assembly combination of claim 10, wherein said connector interlocking cap and said receiver interlocking member are configured to couple through a twist-to-lock mechanism.

16. An electrical assembly combination comprising:

a connector comprising a connector interlocking cap, a flexible device enclosure inside said connector interlocking cap and a compression grommet inside said flexible device enclosure, wherein said connector interlocking cap is configured for direct coupling with a receiver interlocking member on a receiver receptacle, wherein said flexible device enclosure includes a connector slot for said flexible assembly and an internal chamber configured for said compression grommet and a terminal end of a flexible assembly, wherein said terminal end of said flexible assembly comprises a plurality of flexible assembly electrical contacts, wherein said connector is configured such that each one said of flexible assembly electrical contacts is mated to a corresponding one of a plurality of receiver electrical contacts in said receiver receptacle by a solderless connection within an enclosure formed when said connector is coupled with said receiver receptacle.

17. The electrical assembly combination of claim 16, wherein said receiver is configured at an opposing end to said receiver interlocking member to mechanically couple to a rigid assembly with a plurality of rigid assembly electrical contacts such that each one of said plurality of rigid assembly electrical contacts is electrically coupled to a corresponding receiver housing electrical contact.

18. The electrical assembly combination of claim 16, wherein said receiver receptacle comprises a receiver housing and said plurality of receiver electrical contacts, wherein said receiver housing is configured at a first end to mechanically couple to a rigid assembly with a plurality of rigid assembly electrical contacts such that each one of said plurality of receiver electrical contacts is electrically coupled to a corresponding one of said of rigid assembly electrical contacts, wherein said receiver housing further comprises said receiver interlocking member at a second end.

19. The electrical assembly combination of claim 16, wherein said connector further comprises a flexible device enclosure for enclosing and sealing said terminal end of said flexible assembly inside said connector.

20. The electrical assembly combination of claim 16, wherein said receiver further comprises an insulator assembly configured to electrically isolate one receiver housing electrical contact from another receiver housing electrical contact.

* * * * *